US006095222A

United States Patent [19]

Voss

[11] Patent Number: 6,095,222

[45] Date of Patent: Aug. 1, 2000

[54] LIFT CORD ADJUSTMENT SYSTEM

[75] Inventor: Robert J. Voss, Fountain Valley, Calif.

[73] Assignee: Newell Operating Co., Rockford, Ill.

[21] Appl. No.: 09/252,581

[22] Filed: Feb. 18, 1999

[51] Int. Cl.[7] ..... E06B 3/48

[52] U.S. Cl. ..... 160/84.05; 160/168.1 R; 160/178.1 R

[58] Field of Search ..... 160/84.04, 84.05, 160/168.1 R, 173 R, 178.1 R, 84.06

[56] References Cited

U.S. PATENT DOCUMENTS

| | | | |
|---|---|---|---|
| 2,600,062 | 6/1952 | Lorentzen | 160/178.1 R |
| 2,861,631 | 11/1958 | Anderle | 160/173 R |
| 3,282,890 | 11/1966 | Preziosi | 160/168.1 R |
| 4,673,018 | 6/1987 | Judkins | 160/1 R |
| 4,722,382 | 2/1988 | Vecchiarelli | 160/178.1 R |
| 4,886,102 | 12/1989 | Debs | 160/178.1 R |
| 4,901,419 | 2/1990 | Voss | 160/84.04 |
| 5,482,100 | 1/1996 | Kuhar . | |
| 5,655,590 | 8/1997 | Bryant | 160/168.1 R |
| 5,918,656 | 7/1999 | Daniels | 160/173 R |

FOREIGN PATENT DOCUMENTS

| | | | |
|---|---|---|---|
| 96266 | 6/1960 | Norway | 160/178.1 |

*Primary Examiner*—Blair M. Johnson
*Attorney, Agent, or Firm*—Foley & Lardner

[57] ABSTRACT

A system for adjusting the length of lift cords used for raising and lowering a bottom rail of a window covering with respect to a head rail includes a receiving element for each lift cord located in the bottom rail and moveable along the length of the bottom rail. A locking element for each receiving element is arranged for being selectively inserted into the receiving element along the bottom rail. The lift cord is attached to one of the receiving element or the locking element. In its most preferred form, the window covering is a fabric window covering, such as a cellular window covering, the receiving element includes a channel which contains at least one cell of the fabric, and the locking element includes a wedge-shaped plate to be inserted into the channel.

21 Claims, 2 Drawing Sheets

FIG. 2
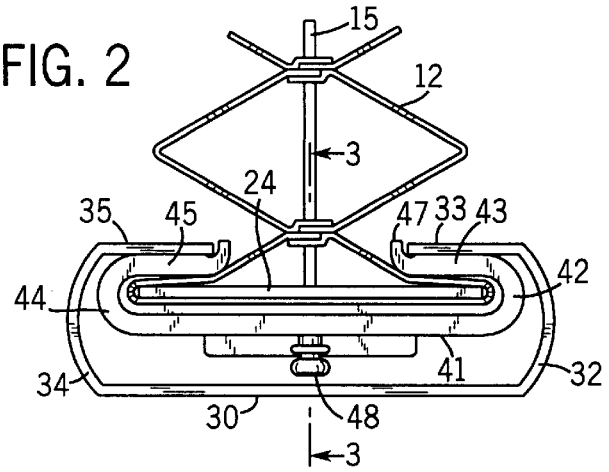
FIG. 3
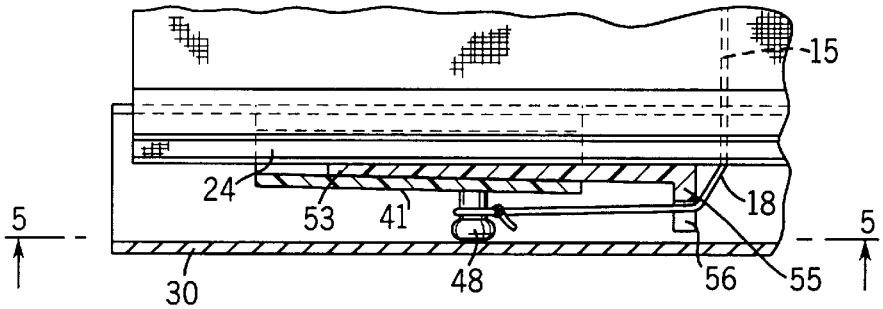
FIG. 4
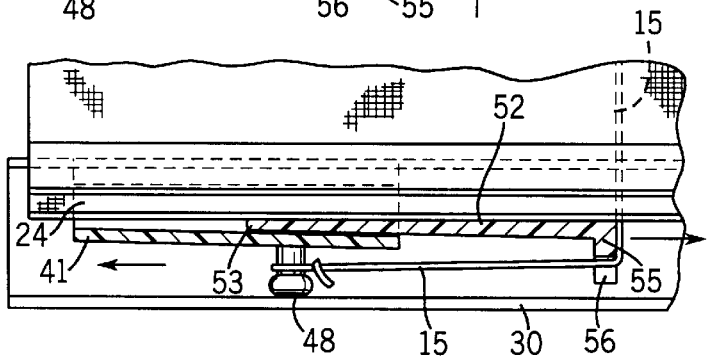
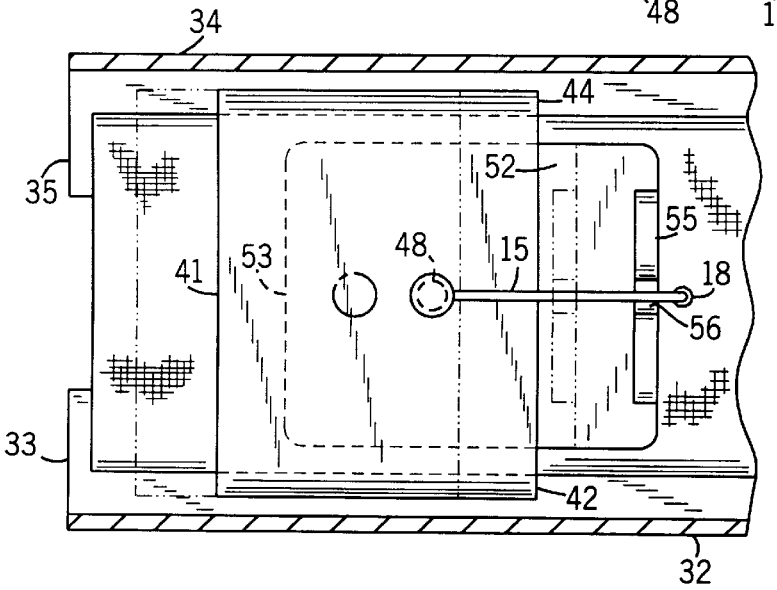
FIG. 5

LIFT CORD ADJUSTMENT SYSTEM

CROSS-REFERENCES TO RELATED APPLICATIONS, IF ANY

None

BACKGROUND OF THE INVENTION

1. Field of the Invention

The present invention relates generally to the art of window coverings, and more particularly to the types of window coverings which include a head rail, a bottom rail and lift cords, such as horizontal blinds, pleated shades, cellular window coverings, Roman shade products, light control window coverings and the like. In its most preferred form, the present invention relates to a system for adjusting the length of the lift cords using a mechanism located within the bottom rail, so that in a fully lowered position, the bottom rail will hang at a desired distance from the head rail and will be level.

2. Description of the Prior Art

A wide variety of different types of window coverings are known which include lift cords. Familiar examples include horizontal venetian-type blinds, sometimes referred to as mini-blinds, pleated shade window coverings, cellular window coverings, various light control products and certain Roman shade products. Typically, such window coverings include a head rail mounted at the top of a window, window covering material coupled to or suspended from the head rail and a bottom rail coupled to the lower end of the window covering material or supports therefor. With venetian-type blinds, a ladder system is employed to suspend a plurality of slats in a horizontal orientation between the head rail and bottom rail, and two or more lift cords are passed through each slat from the bottom rail to the top rail. Typically the lift cord passes through holes in each slat, although other systems are known in the art. Most frequently, the lift cords are directed by pulleys or other mechanisms in the head rail to one end of the head rail, at which point they descend along one side edge of the window covering so that they can be manipulated by the user. By pulling on the lift cords, the bottom rail is moved toward the top rail, with corresponding accumulation of slats on the bottom rail as upward movement continues.

Similar lift cord systems are used in a variety of the "soft" window products which are currently popular, including window coverings which have pleated fabric between the head rail and the bottom rail, window coverings which have cellular fabric material between the head rail and the bottom rail, light control products which include cells having opaque portions arranged between the bottom rail and the head rail for light control and the like.

Systems are also known wherein the lift cords may accumulate on spring motor reels within the head rail so that they do not exit the head rail at all. Such a system is shown in U.S. Pat. No. 5,482,100 issued Jan. 9, 1996 to Kuhar entitled "Cordless, Balanced Venetian Blind Or Shade With Consistent Variable Force Spring Motor". This system uses spring motors to balance the weight of the bottom rail and the accumulating window covering material as the window covering is raised or lowered by simply grasping the bottom rail and urging it upwardly or downwardly.

One problem common to such window coverings is the adjustment of the lift cords so that the window coverings may be deployed a predetermined amount. For example, with most window coverings, it is desired that in the fully lowered position, the bottom rail will extend across the window sill and be spaced a small distance above it. Because it is practically impossible to manufacture window coverings in all possible lengths, fabricators or installers typically adjust the lift cord length in accordance with specific instructions, thereby adding to the ultimate cost to the consumer. A variety of techniques are well-known in the art for adjusting the length of the lift cords, including various mechanisms within the bottom rail to which the lift cords are attached and to which the lift cords can be adjustably secured for the proper length. Many of such systems are complex, making it difficult to quickly and inexpensively achieve the desired adjustment. Some mechanisms adjust both lift cords, while other adjust one lift cord which, in turn, is coupled to the other lift cord thereby providing equal adjustment.

While known systems do provide length adjustment, they suffer from one or more drawbacks with regard to installation and/or use. For example, it may be necessary, if a window covering is to be used at a new location, to re-adjust the length of the lift cords for that particular window to achieve the desired aesthetic result. An untrained user may not be able to provide such adjustment in an accurate manner.

A system for adjusting the length of lift cords in window coverings which would be easily understood and used by consumers would represent a significant advance in this art.

FEATURES AND SUMMARY OF THE INVENTION

The present invention features a lift cord adjustment system which is widely adaptable to different types of window coverings and which is inexpensive, easy to install and easy to adjust.

The present invention also features a lift cord adjustment system which may be used by untrained consumers after a window covering has been fabricated and/or installed.

A different feature of the present invention is to provide a lift cord adjustment mechanism which may be used for a variety of sizes of window coverings and which may be manufactured in different configurations and which may be used with window coverings having a variety of lift cord arrangements, including window coverings having more than two lift cords.

How these and other features of the present invention are accomplished will be described in the following detailed description of the preferred embodiment, taken with the FIGURES. Generally, however, they are accomplished by providing at least one receiving member located in the bottom rail for adjustable movement therealong during the lift cord length adjustment process. A locking component is provided, one for each receiving member, a lift cord being attached to one of the receiving component or the locking component. The locking component is releasably received in the receiving member to firmly secure one to the other. By movement of the receiving member to an appropriate location, the lift cords are thereby adjusted to the appropriate length. In the preferred and illustrated embodiment, the receiving member includes a slot or channel and the locking component has a wedged-shaped plate adapted to be inserted into the slot. The engagement of the wedge-shaped plate with the slot locks the components together and frictionally secures the receiving member against further movement with respect to the window covering and provides a readily adjustable technique for the length adjustment of window covering lift cords. Other ways in which the features of the invention are accomplished will become apparent to those skilled in the art after they have read the present specification. Such other ways are deemed to fall within the scope of the present invention if they fall within the scope of the claims which follow.

DESCRIPTION OF THE DRAWINGS

In the following drawings, like reference numerals are used to denote like components.

FIG. 2 is an end view of a portion of the system shown in FIG. 1;

FIG. 3 is a side sectional view taken along the line 3—3 of FIG. 2;

FIG. 4 is a side sectional view similar to FIG. 3 but showing the two major system components in only a partially coupled position; and FIG. 5 is a bottom view of the system taken along the line 5—5 of FIG. 3.

DETAILED DESCRIPTION OF THE PREFERRED EMBODIMENT

Figure 1:
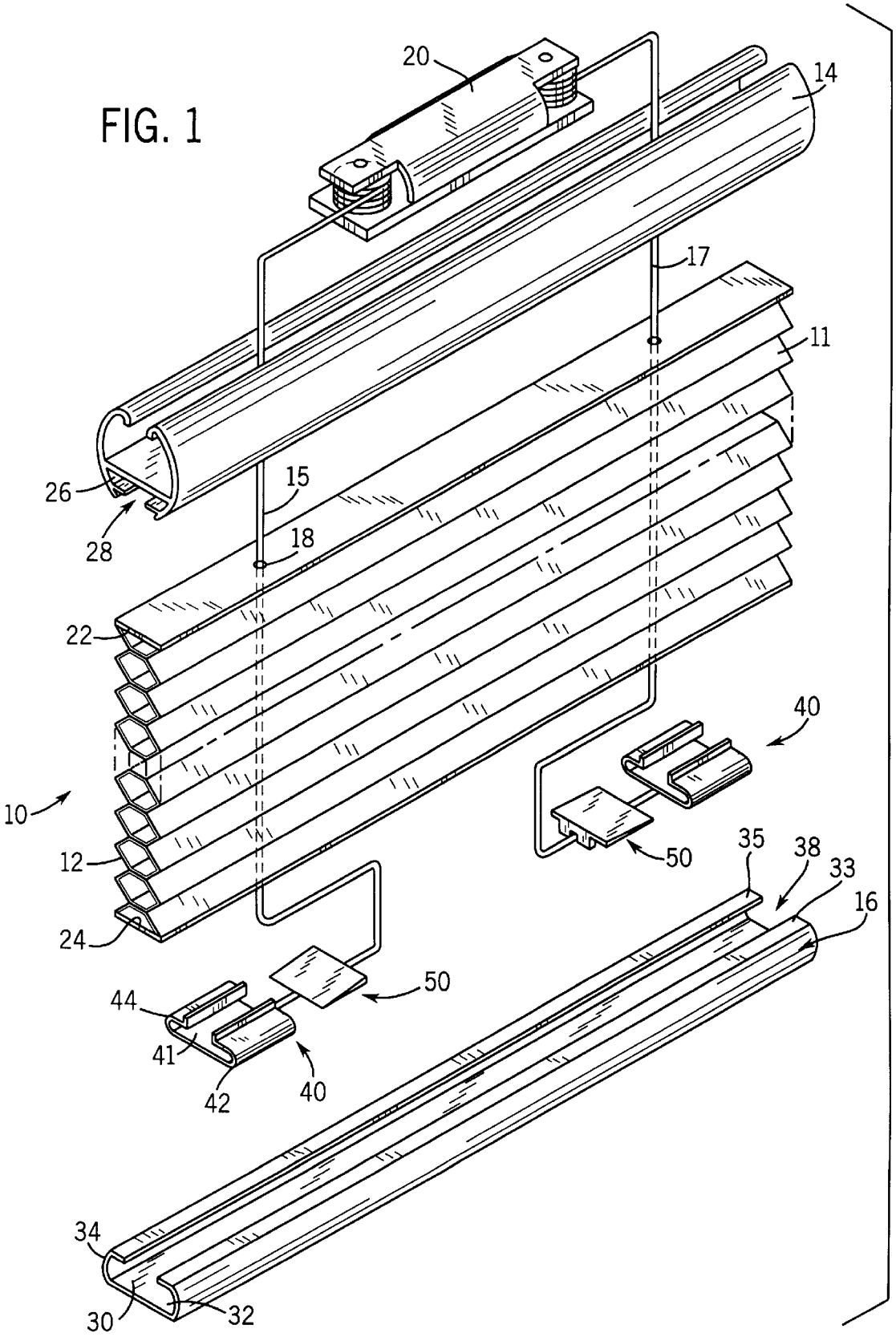
FIG. 1 is a perspective exploded view of the lift cord adjustment system of the present invention.

Before proceeding to the detailed description of the preferred embodiment, several general comments are warranted about the applicability and the scope of the present invention.

First, the illustrations show the lift cord adjustment system of the present invention used with a cellular window material. However, it should be understood at the outset, that the system of the present invention can be used with any of the window coverings mentioned above or with other window coverings known to the art which employ one or more lift cords passing into a bottom rail.

Second, the technique of securing the receiving component of the present invention at a particular location can be variously embodied. While the illustrations show a receiving component wedged against a lower portion of the window covering material to hold it in place, alternate techniques may certainly be employed. For example, the receiving component may frictionally engage the bottom rail itself and be totally separate from any component of the window covering material. Such fit could be achieved by manufacturing an exterior of the receiving component to match closely the internal profile of the bottom rail, or by using materials which have resiliency and compressibility such that they can be moved along the bottom rail to the desired location while in a compressed state and be released to lock the receiving component at the desired location.

Third, the illustrations show two lift cords and two length adjustment systems according to the present invention. However, many window coverings, especially wider window coverings, will have more than two lift cords. It should be appreciated that in the present invention such modifications can easily be accomplished by providing an additional pair or additional pairs of receiving and locking components.

Fourth, a simple bottom rail profile is shown in the illustration, but a number of "designer" bottom rails are known. These can easily accommodate the system of the present invention, and the two major components can be adapted to a wide variety of bottom rail configurations.

Fifth, plastic material, such as polyethylene or polypropylene are preferably used for the construction of the two major components of the system of the preferred embodiment, but other materials such as metals or metal alloys could be used without departing from the invention's intended scope.

Finally, it should be appreciated that the component to which the lift cord is attached and the component which engages either the material or the bottom rail can be reversed. In other words, after one familiar with this art concludes a review of the specification, he or she would understand that the wedge containing locking component could be the one to which the lift cord is attached and be fixed against the material or against the bottom rail, with the receiving component being movable with respect thereto to lock the components to one another. In either arrangement, the one depicted or the one just described, some freedom of movement of the component to which the lift cord is attached should exist until the two components are urged into firm engagement with one another, at which point the lift cord holding element will resist frictional movement, thereby providing a secure adjustment of the lift cord length.

Proceeding now to a description of the most preferred embodiment of the invention, a window covering 10 is shown in FIG. 1 to include cellular window covering material 11 comprised of individual cells 12. The window covering includes a top rail 14 and a bottom rail 16 each of which will be described in greater detail later. Window covering 10 also includes a pair of lift cords 15 and 17 which are arranged in a conventional manner and extend through openings 18 in the window covering material 11. Lift cords 15 and 17 extend entirely through the window covering material 11 and at their upper ends pass into the head rail 14 and are coupled to a spring motor 20 of the type described in the aforementioned Kuhar application. Other conventional ways of handling and deploying the upper ends of the lift cords may be substituted for the illustrated spring motor 20.

The window covering 11 is shown with a pair of slats 22 and 24 disposed respectively in the uppermost and lowermost cells 12 of window covering 11. These slats are used to couple the window covering material 11 to the head rail 14 and bottom rail 16 in one way which is known in the art. To attach the uppermost cell 12 to head rail 14, a cell would be placed into a chamber 26 extending along the underside of head rail 14. A slot 28 extending along the bottom of chamber 28 has a width less than the width of the slat 22. After the cell is placed into chamber 26, the slat 22, preferably constructed of a rigid material, is inserted into the cell and will prevent removal of the window covering from the head rail. Obviously, the head rail will also include hardware components for attaching the head rail to the window, the window frame or an adjacent wall, as is well-known. These techniques are not shown as, in and of themselves, they form no part of the present invention.

A similar technique is used to secure the lowermost cell to bottom rail 16. A simple form of bottom rail profile is shown in the FIGURES, namely one which includes a flat bottom plate 30, having opposed and generally C-shaped edges 32 at the front and 34 at the back, respectively. The directions are taken with respect to the window covering 10 illustrated in FIG. 1. Edges 32 and 34 terminate in generally flat and inwardly extending flanges 33 and 35, respectively, which have a gap 38 between them which is narrower than the width of slat 24. When the lowermost cell of window covering 11 is inserted into bottom rail 16, and slat 24 is inserted along its length, window covering 11 will be securely coupled to bottom rail 16.

As is also known in the art, adjustment of the overall length of the window covering 11 may be accomplished for cellular window coverings by storing more than a single cell in either the head rail 14 or the bottom rail 16. The present invention does not concern itself with such adjustments, and it would be helpful here to remind the reader that the cellular window covering is being shown as an illustrative type of window covering, rather than for any purpose of limiting the scope of the present invention. As the reader proceeds through this specification, it will become more apparent that the type of receiving element to be described below will depend primarily on the nature of the window covering and any other hardware which may be located in the bottom rail which would be used in conjunction therewith.

The remaining two components of the window covering 10 according to the illustrated and most preferred embodiment are a pair of receiving members 40 and a pair of complimentary locking elements 50. The shape of receiving elements 40 can best be appreciated by reference to FIGS. 1 and 2. It is generally similar in vertical cross-section to bottom rail 16, but is smaller and includes a bottom plate 41, forward and rear C-shaped edges 42 and 44, and a pair of inwardly extending flanges, 43 and 45 respectively. Flanges 43 and 45 terminate at their inner edges in generally upturned tips 47.

The illustrated receiving members 40 have a width approximately equal to that of the slat 24 and a depth between the bottom plate 41 and the inwardly directed flanges 43 and 45 selected to accommodate the lowermost cell material and the thickness of slat 24. Ideally, in this embodiment, the receiving element should slide somewhat freely along the lowermost cell and inserted slat 24, but frictionally engage these components so that the receiving elements 40 will remain in place during fabrication, once the manufacturer slides them to a desired location.

The locking elements 50 can best be appreciated by reference to FIGS. 1 and 3–5. They each include a plate 52 which is rectangular in vertical and lateral cross-section, but wedge-shaped in longitudinal and vertical cross-section. Plate 52 has a width less than the width of receiving elements 40 and a thickness at its thinnest end 53 small enough to allow the wedge-shaped plate 52 to be inserted into receiving element 40 below the lowermost part of the cellular window covering material 11. The thickness is selected such that, as the locking element 50 is moved further into receiving element 40, a wedging force will be exerted so as to lock the two elements together and to lock the receiving elements 40 from further freedom of movement along the lowermost cell of the window covering material 11.

FIG. 4 illustrates the situation in which the thin end of the locking element plate 52 is inserted into receiving element 40 but showing some space 56 above and/or below plate 52. FIG. 3 illustrates the locked position in which the locking element 50, the receiving element 40 and the window covering are firmly pressed together.

The lift cord adjustment aspect of the invention can now be more clearly appreciated. Receiving element 40 includes a knob 48 on the lower surface of plate 41 adapted and arranged to receive the lower end of a lift cord 15 or 17. A downwardly extending flange 55 is provided on locking element 50, a generally U-shaped notch 56 being formed therein at the center of the flange 55. As noted in FIGS. 2–5, the lift cord extends down through the cells and exits a hole 18 in the lowermost cell (see FIG. 5). The lift cord then passes through notch 56 and is tied or otherwise affixed to knob 48. To provide length adjustment of such lift cord, the fabricator will slide receiving element 40 along the bottom cell and inserted slat 24 until the length of the lift cord is adjusted for the particular end use. While holding the receiving element 40 in that preselected location, the locking element 50 is inserted and urged tightly into receiving element 40. The lift cord at this point will reside in the notch 56. A corresponding set of manufacturing operations will then be followed for lift cord 17, whereafter both lift cords are adjusted for the window covering 10. The bottom rail 16 is thereafter placed over the receiving elements 40 and end caps (not shown) are inserted and the length adjustment is complete.

As will best be appreciated from FIG. 2, the upturned tips 47 of receiving elements 40 may be used to center the receiving elements 40 within the head rail. Tips 47 need not be present at all if other designs are used for receiving elements 40. For example, and using the illustrations to describe an alternative, the receiving element 40 could be constructed to provide a relatively tight friction fit within bottom rail 16 and include feet, extensions or other elements to contact the edges 32 and 34 or portions of the bottom plate 30 of the bottom rail 16 when the rail is placed thereover. These alternative constructions for the receiving element may become the preferred embodiment for window coverings other than the cellular window covering 10 shown in the FIGURES. For example, with horizontal mini-blinds, where a cell and slat would not be provided in the bottom rail, the receiving element 40 would be constructed with only a sufficient depth to receive a portion of plate 52 of the locking element 50 and be independent of any element of the window covering material itself. Locking the lift cord and frictionally engaging the bottom rail around the receiving element would accomplish the desired lift cord length adjustment according to the teachings of the present invention.

While a single embodiment has been described and illustrated above, the invention is not limited to that embodiment, but is to be limited solely by the scope of the claims which follow.

What is claimed is:

1. A lift cord adjustment system for a window covering comprising a head rail, a bottom rail, window covering material between the head rail and bottom rail and at least one lift cord extending from the bottom rail to the head rail adapted for raising and lowering the bottom rail with respect to the head rail, the system comprising the window covering and:

a receiving element in the bottom rail for each lift cord, each receiving element being movable along the bottom rail;

a locking element in the bottom rail for each receiving element including structure adapted to be moved from a position in which it is spaced from a receiving element to another position in which it engages an associated receiving element to prevent movement of that receiving element along the bottom rail;

a lift cord attachment portion on one of the receiving element or the locking element for fixed attachment of an end of the lift cord; and the lift cord being attached to the portion.

2. The adjustment system of claim 1 wherein each receiving element includes a channel and each locking element includes a plate insertable into the channel.

3. The adjustment system of claim 2 wherein the channel has an open interior and includes a generally planar bottom, generally C-shaped front and back edges and a top spaced apart from but generally parallel to the planar bottom, and the plate is wedged-shaped.

4. The adjustment system of claim 2 wherein the window covering is a fabric and part of the fabric is located in the channel of each receiving element.

5. The adjustment system of claim 4 wherein the channel has an open interior and includes a generally planar bottom, generally C-shaped front and back edges and a top spaced apart from but generally parallel to the planar bottom, and the plate is wedged-shaped.

6. The adjustment system of claim 4 wherein the window covering material is a cellular fabric and at least one cell is located in the channel of each receiving element.

7. The adjustment system of claim 6 wherein the channel has an open interior and includes a generally planar bottom, generally C-shaped front and back edges and a top spaced apart from but generally parallel to the planar bottom, and the plate is wedged-shaped.

8. The adjustment system of claim 6 wherein a rigid slat is located in a cell located in the channel of each receiving element, the channel including a slot having a width less than the width of the slat.

9. The adjustment system of claim 8 wherein the plate is wedge-shaped and prevents movement of each receiving element by compressing the cell and slat against the interior of the channel.

10. The adjustment system of claim 9 wherein the bottom rail has a hollow interior having a vertical cross-sectional profile generally similar to but slightly larger than a receiving element so that each receiving element may slide along the interior of the bottom rail until its associated locking element is engaged therewith.

11. The adjustment system of claim 1 wherein the attachment portion is a knob located on each receiving element.

12. The adjustment system of claim 8 wherein the attachment portion is a knob located on each receiving element.

13. A method for adjusting the length of a lift cord for a window covering of the type including a head rail, a bottom rail, window covering material between the head rail and bottom rail and at least one lift cord extending from the bottom rail to the head rail and adapted for raising and lowering the bottom rail with respect to the head rail, the method comprising the steps of:

(a) attaching an end of the at least one lift cord to one of a respective receiving element or locking element;

(b) placing the receiving element for each lift cord at a desired location along the length of the bottom rail;

(c) thereafter engaging the locking element with the respective receiving element to prevent movement of each receiving element along the length of the bottom rail.

14. The method of claim 13 wherein each receiving element includes a channel and each locking element includes a plate insertable into the channel.

15. The method of claim 14 wherein the channel has an open interior and includes a generally planar bottom, generally C-shaped front and back edges and a top spaced apart from but generally parallel to the planar bottom, and the plate is wedged-shaped.

16. The method of claim 14 wherein the window covering material is a fabric and the method comprises the further step of inserting a lower portion of the fabric into the channel of the receiving element before the placing step.

17. The method of claim 16 wherein the window covering material is a cellular fabric and the inserting step comprises inserting at least one cell of the window covering material into the channel.

18. The method of claim 17 including the further step of inserting a rigid slat into a cell located within the channel.

19. The method of claim 13 wherein the receiving element includes a knob and the attaching step comprises tying the end of the lift cord to the knob.

20. In a lift cord attachment system for a window covering including a head rail, a hollow bottom rail, cellular window covering material between the head rail and the bottom rail, at least two spaced apart lift cords extending from the bottom rail to the top rail and adapted for raising and lowering the bottom rail with respect to the head rail, at least one cell of the material located within the bottom rail and a rigid elongate slat extending through a cell located within the bottom rail, the improvement comprising:

receiving element for each lift cord surrounding the cell and slat within the bottom rail and being adapted for slidable movement along the length of the bottom rail;

a wedge-shaped locking element for each lift cord adapted for being removably inserted into the receiving element to prevent movement of the receiving element along the length of the bottom rail; and each lift cord being attached to one of its associated receiving element or locking element.

21. The attachment system of claim 20 wherein the receiving element has an interior surface and the locking element wedges between the interior surface and the cell when inserted into the receiving element thereby preventing movement of the receiving element with respect to the bottom rail.

* * * * *